US011382442B2

(12) United States Patent
Storey-Knight et al.

(10) Patent No.: US 11,382,442 B2
(45) Date of Patent: Jul. 12, 2022

(54) WINE GLASS FLOAT

(71) Applicants: Amber Storey-Knight, Jackson, TN (US); Herbert E Williams, II, Jackson, TN (US)

(72) Inventors: Amber Storey-Knight, Jackson, TN (US); Herbert E Williams, II, Jackson, TN (US)

( * ) Notice: Subject to any disclaimer, the term of this patent is extended or adjusted under 35 U.S.C. 154(b) by 0 days.

(21) Appl. No.: 15/984,455

(22) Filed: May 21, 2018

(65) Prior Publication Data

US 2019/0350393 A1 Nov. 21, 2019

(51) Int. Cl.
*A47G 23/02* (2006.01)

(52) U.S. Cl.
CPC ..... *A47G 23/0216* (2013.01); *A47G 2200/02* (2013.01)

(58) Field of Classification Search
CPC ..... B65D 7/00–32; B65D 11/00–1846; B65D 11/14; B65D 7/14; A45F 2200/0583; A61J 1/16; A61J 1/65
See application file for complete search history.

(56) References Cited

U.S. PATENT DOCUMENTS 3,918,355 A * 11/1975 Weber ..... A47J 31/38 99/283
4,162,749 A * 7/1979 Bennett ..... B05B 11/043 222/207
6,029,845 A 2/2000 Mueller
6,616,493 B2 9/2003 Powell et al.
6,991,505 B1 1/2006 Wells
8,365,931 B2 * 2/2013 Rees ..... B65D 81/245 215/231
8,746,502 B2 * 6/2014 Lambrecht ..... B67D 1/0412 141/11
8,770,434 B2 7/2014 Shearer
9,938,131 B2 * 4/2018 Tomesch ..... B67D 3/0051
2002/0088827 A1 * 7/2002 Colucci ..... B65D 81/245 222/386
2013/0008924 A1 * 1/2013 Lafosse ..... B05B 11/0013 222/256
2014/0252037 A1 * 9/2014 Poggio ..... B65D 11/04 222/152
2015/0321807 A1 * 11/2015 Cotton ..... A47G 19/12 220/227

* cited by examiner

*Primary Examiner* — Kareen K Thomas
(74) *Attorney, Agent, or Firm* — Davd J Kreher

(57) ABSTRACT

A wine float for the purpose supporting a beverage container with a base, stem and bowl. The wine float comprises a body, a central hole and a gap such that the gap extends from the central hole, through the body, to the outside edge of the body. The central hole is of a sufficient diameter to allow the bowl of the beverage container to rest in the central hole without allowing the bowl of the beverage container to pass entirely through the central hole. The gap is sufficiently wide to allow the stem of the of the beverage container to pass through the gap but sufficiently narrow so that neither the base of the beverage container nor the bowl of the beverage container can pass through the gap.

8 Claims, 6 Drawing Sheets

WINE GLASS FLOAT

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC

Not Applicable

DESCRIPTION

Field of the Invention

This disclosure relates to a wine float for the purpose supporting a beverage container with a base, stem and bowl. The wine float comprises a body, a central hole and a gap such that the gap extends from the central hole, through the body, to the outside edge of the body. The central hole is of a sufficient diameter to allow the bowl of the beverage container to rest in the central hole without allowing the bowl of the beverage container to pass entirely through the central hole. The gap is sufficiently wide to allow the stem of the of the beverage container to pass through the gap but sufficiently narrow so that neither the base of the beverage container nor the bowl of the beverage container can pass through the gap.

Background of the Invention

Beverage floats have been developed that float in water while suspending cans or glasses. However, no such float has been developed specifically for beverage containers with a stem. The present disclosure reveals a floatation device for a beverage container with a stem, for example, the beverage container could be a wine glass.

SUMMARY OF THE INVENTION

The present disclosure reveals a wine float for the purpose supporting a beverage container with a base, stem and bowl. The wine float comprises a body, a central hole and a gap such that the gap extends from the central hole, through the body and to the outside edge of the body. The central hole is of a sufficient diameter to allow the bowl of the beverage container to rest in the central hole without allowing the bowl of the beverage container to pass entirely through the central hole. The gap is sufficiently wide to allow the stem of the of the beverage container to pass through the gap but sufficiently narrow so that neither the base of the beverage container nor the bowl of the beverage container can pass through the gap.

In the first embodiment of the wine float the body is comprised of a material with a specific gravity less than that of water such that when a beverage container with liquid is placed into the wine float the wine float and beverage container would be suspended in the water and not sink below the surface of the water, for example, styrofoam or aerated plastics wherein the porosity and lack of permeability create a material with a density less than that of water.

In the second embodiment of the wine float, the body of the wine float is shaped so that when the wine float and beverage container full of liquid is placed in water the combined weight of the wine float plus beverage container displaces less water than the height of the edge of the wine float. In this instance, the shape may have an open top or closed. If closed, the shape may be rigid or inflatable.

In either embodiment, ribbing or a covering may be added to supply structural support to the float.

In either embodiment the wine float further comprises an inner edge and wherein said inner edge is tapered to fit the shape of the beverage container.

DETAILED DESCRIPTION OF THE INVENTION

Figure 1:
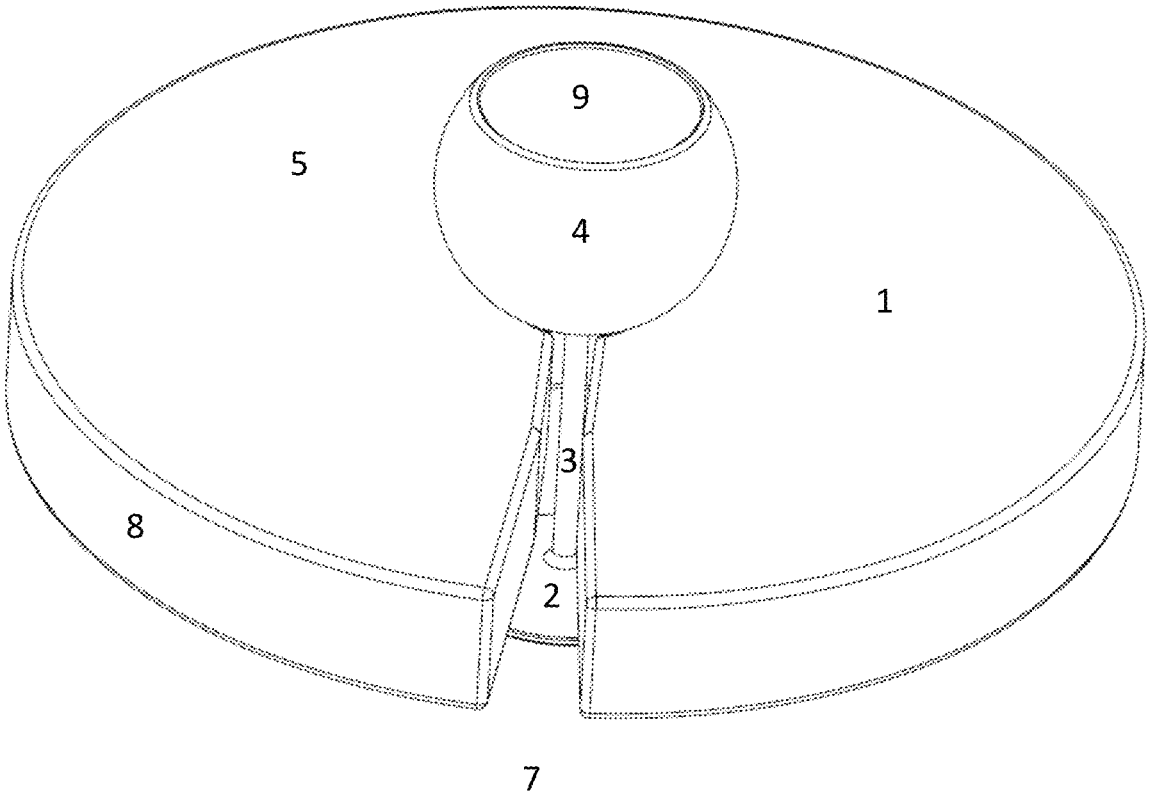
FIG. 1 is a view the wine float supporting a beverage container with a stem.
Figure 2:
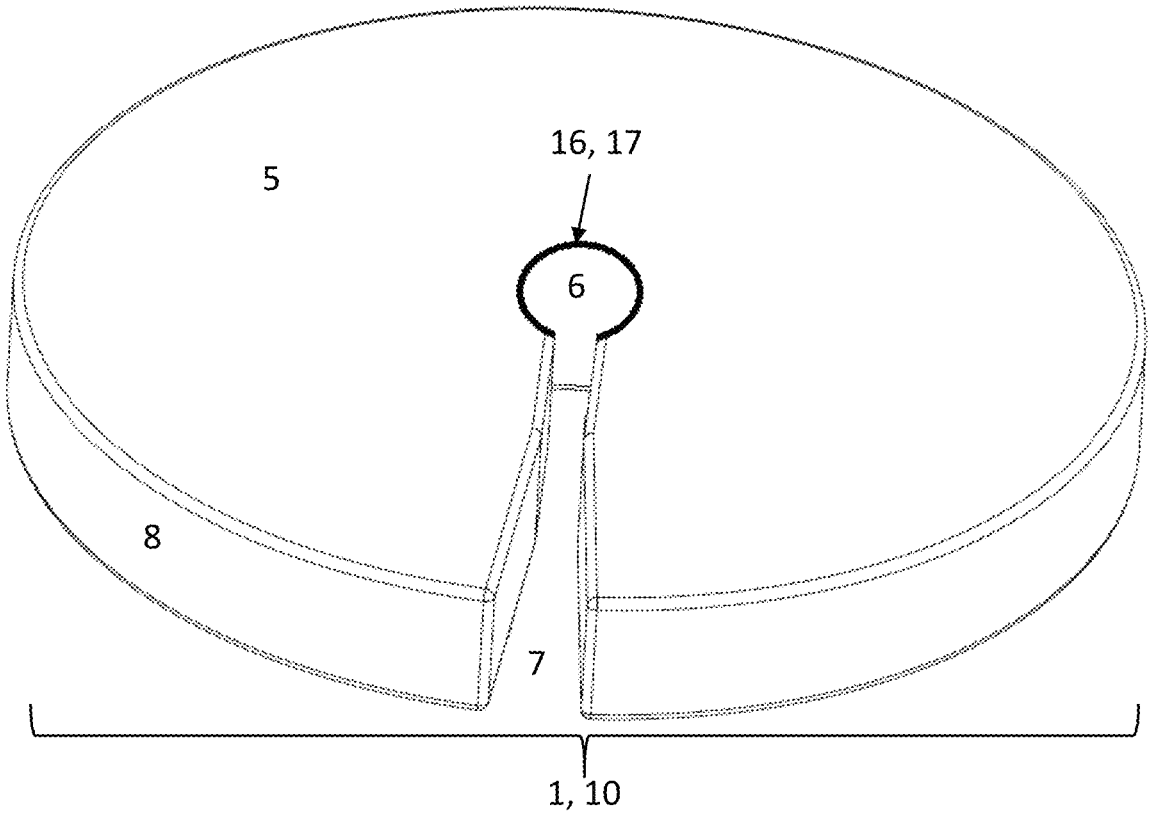
FIG. 2 is a view of the first embodiment of the wine float, wherein the wine float comprises a body, central hole and gap and where the body is comprised of a material with a specific gravity less than that of water.
Figure 3:
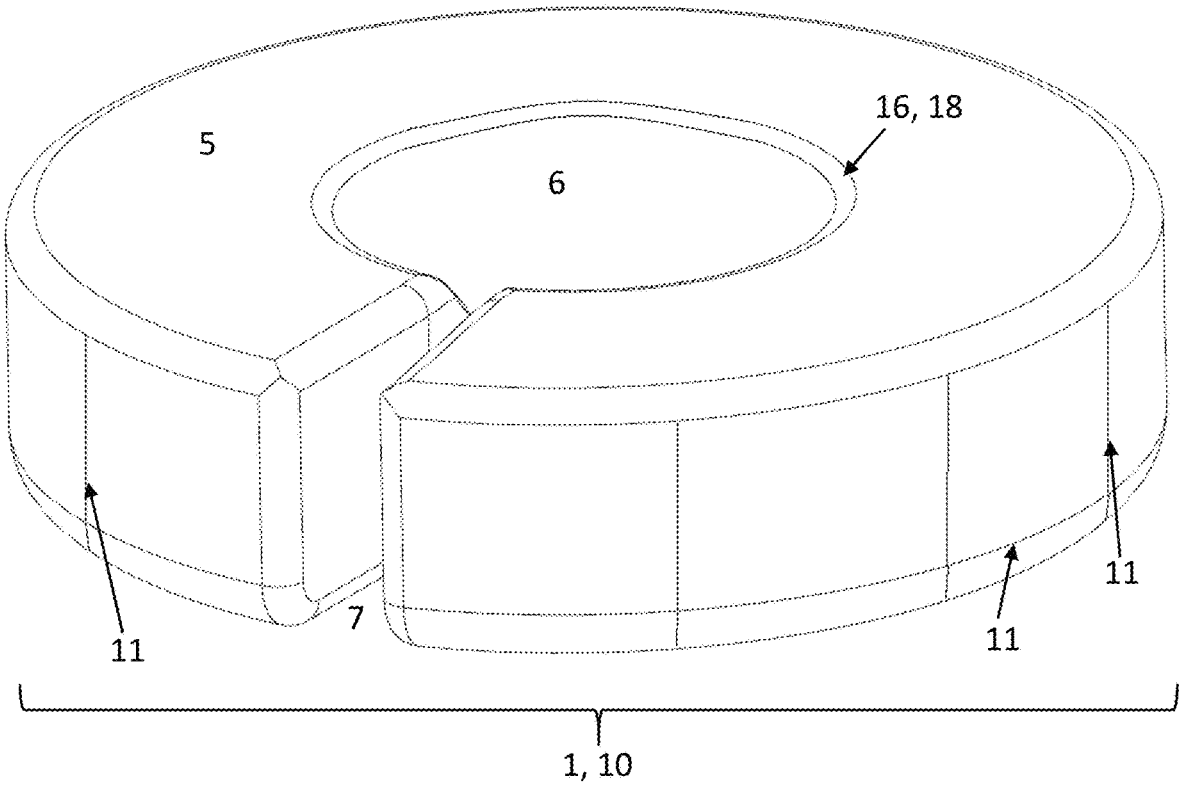
FIG. 3 is a view of the first embodiment of the wine float, wherein the wine float comprises a body, central hole and gap and where the body is comprised of a material with a specific gravity less than that of water and wherein the body further comprises ribbing to increase the durability of the wine float.
Figure 4:
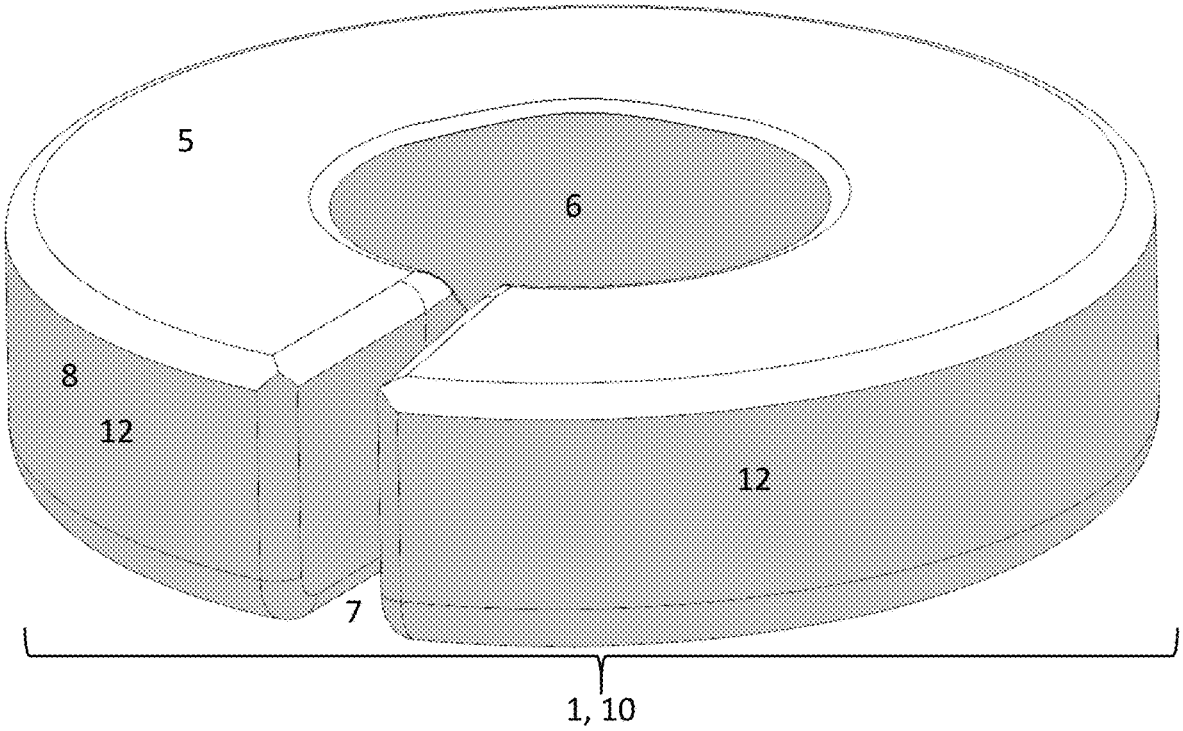
FIG. 4 is a view of the first embodiment of the wine float, wherein the wine float comprises a body, central hole and gap and where the body is comprised of a material with a specific gravity less than that of water and wherein the body is further covered with a material to increase the durability of the wine float.
Figure 5:
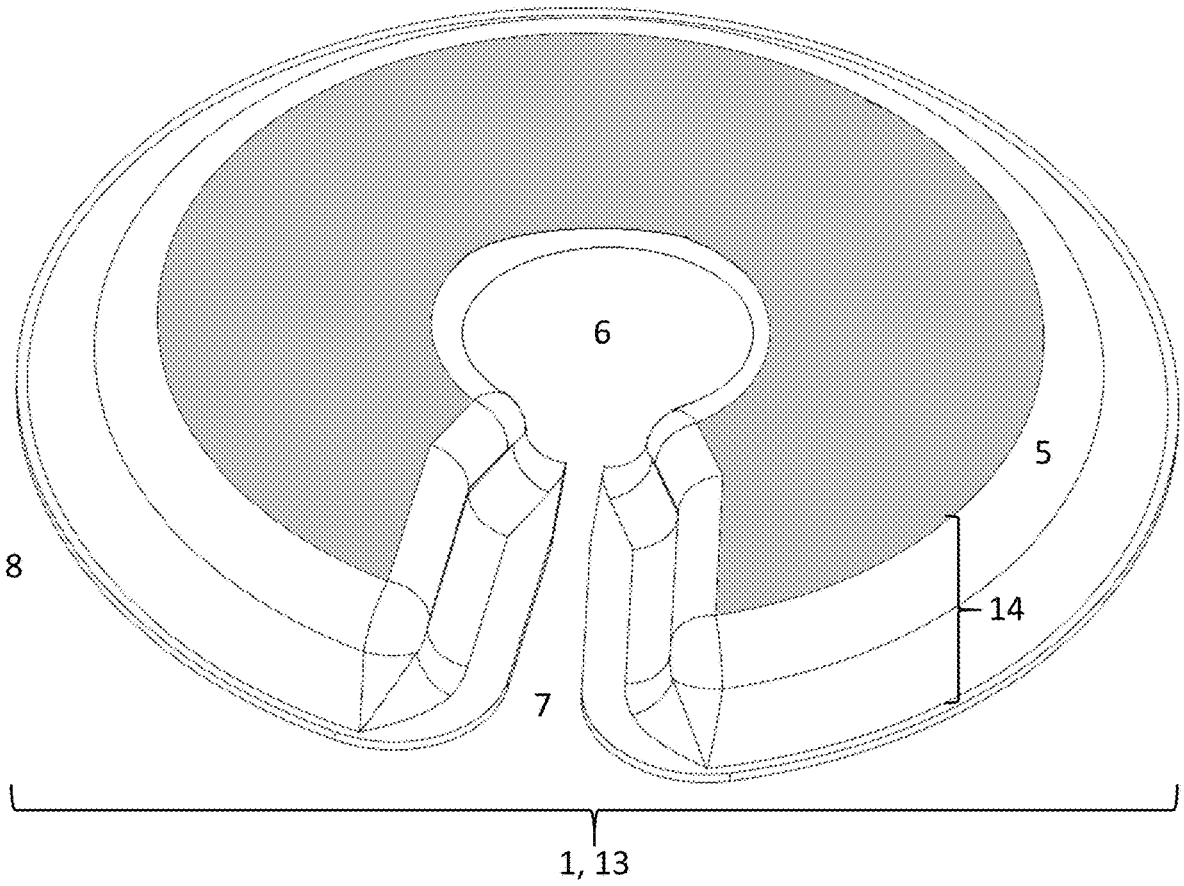
FIG. 5 is a view of the second embodiment of the wine float, wherein the wine float comprises a body, central hole and gap and wherein the wine float is shaped so that when the wine float and beverage container full of liquid is placed in water the combined weight of the wine float plus beverage container displaces less water than the height of the edge of the wine float.
Figure 6:
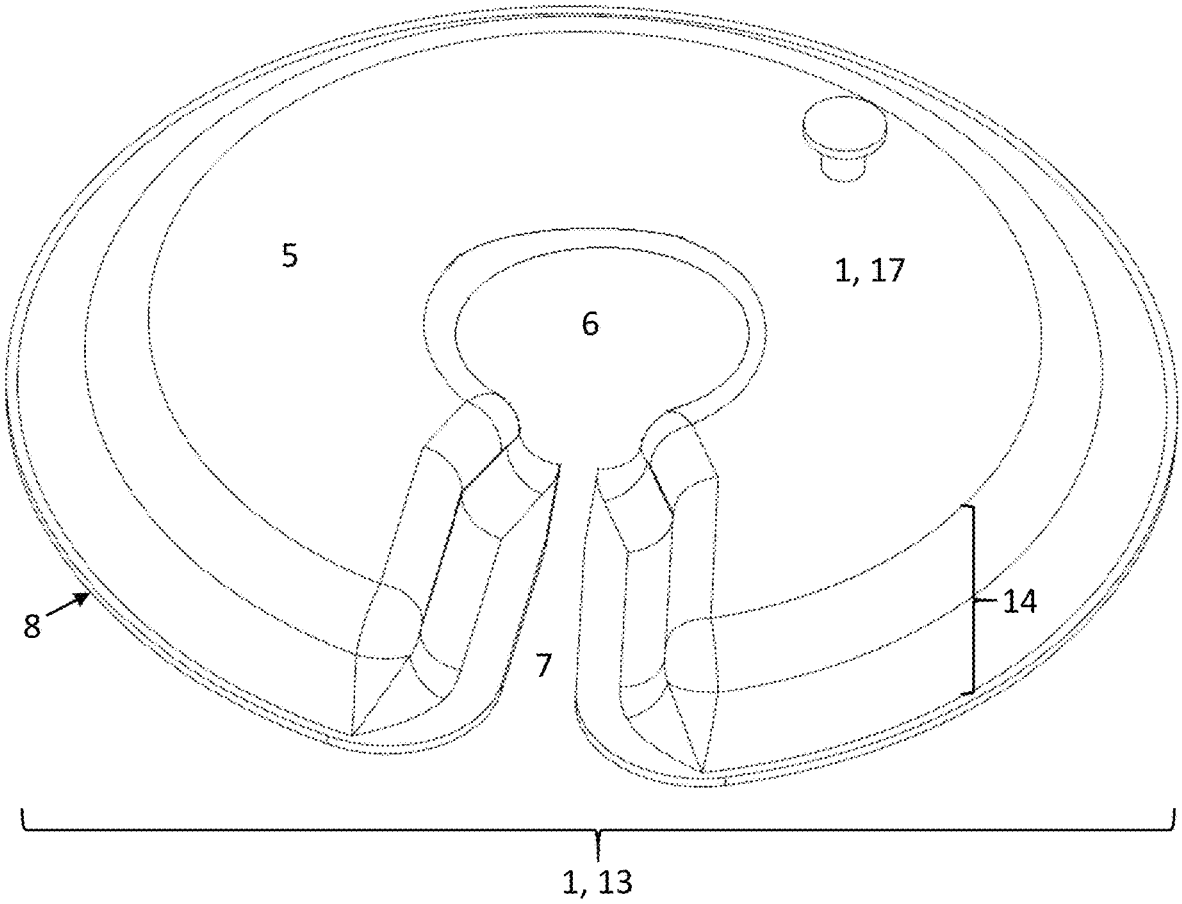
FIG. 6 is a view of the second embodiment of the wine float, wherein the wine float comprises a body, central hole and gap and wherein the wine float is shaped so that when the wine float and beverage container full of liquid is placed in water the combined weight of the wine float plus beverage container displaces less water than the height of the edge of the wine float and wherein the body of the wine float is enclosed.

The present disclosure reveals a wine float 1 for the purpose supporting a beverage container above water wherein the beverage container 9 is comprised of a base 2, stem 3, and bowl 4. The wine float comprises 1 a body 5, a central hole 6, a gap 7. The body further comprising an outside edge 8. The gap 7 extends from the central hole 6, through the body 5 and to the outside edge 8 of the body 5. The central hole 6 is of a sufficient diameter to allow the bowl 4 of the beverage container 9 to rest in the central hole 6 without allowing the bowl 4 of the beverage container 9 to pass entirely through the central hole 6. The gap 7 is sufficient width to allow the stem 3 of the of the beverage container 9 to pass through the gap 7 but sufficiently narrow so that neither the base 2 of the beverage container 9 nor the bowl 4 of the beverage container 9 can pass through the gap 7.

In the first embodiment 10 of the wine float 1 the body 5 is comprised of a material with a specific gravity less than that of water such that when a beverage container 9 with liquid is placed into the wine float 1 the wine float 1 and beverage container 9 would be suspended in the water and not sink below the surface of the water.

The first embodiment 10 may further comprise ribbing 11 to add structural support to the wine float 1.

The first embodiment 10 may further comprise a covering 12 to add structural support to the wine float.

In the second embodiment 13 of the wine float 1, the body 5 of the wine float 1 is shaped so that when the wine float 1 and beverage container 9 full of liquid is placed in water the combined weight of the wine float 1 plus beverage container 9 displaces less water than the height 14 of the outside edge 8 of the wine float 1.

In the second embodiment 13 of the wine float 1, the body 5 may further comprise a cover 15 to enclose the body such that the body may be inflatable or a rigid structure.

In each of the embodiments of the wine float 1 the inner edge 16 may be straight 17 or tapered 18 to the shape of the beverage container 9.

What is claimed:

1. A wine float for supporting a beverage container above water, the beverage container is comprising of a base, stem and bowl, wherein the wine float comprises:

a body, a central hole, a gap, an inside edge, and an outside edge;

the body is comprised of a material with a specific gravity less than that of water such that when a beverage container with liquid is placed into the wine float the wine float and beverage container is suspended in the water and not sink below the surface of the water and further comprising an outside edge;

the central hole is of a sufficient diameter to allow the bowl of the beverage container to rest in the central hole without allowing the bowl of the beverage container to pass entirely through the central hole; and the gap extends from the central hole, through the body, to the outside edge of the body and is of sufficient width to allow the stem of the beverage container to pass through the gap, but the gap is sufficiently narrow so that neither the base of the beverage container nor the bowl of the beverage container can pass through the gap.

2. The wine float of claim 1, wherein the wine float further comprises an inner edge and wherein said inner edge is tapered.

3. The wine float of claim 1, wherein the body is further comprised of ribbing to add structural support to the wine float.

4. The wine float of claim 3, wherein the wine float further comprises an inner edge and wherein said inner edge is tapered.

5. The wine float of claim 1, wherein the body is further comprised of a covering to add structural support to the wine float.

6. The wine float of claim 5, wherein the wine float further comprises an inner edge and wherein said inner edge is tapered.

7. The wine float of claim 5, wherein the body is further comprised of ribbing to add structural support to the wine float.

8. The wine float of claim 7, wherein the wine float further comprises an inner edge and wherein said inner edge is tapered.

* * * * *